US009548564B2

(12) United States Patent
Wu et al.

(10) Patent No.: US 9,548,564 B2
(45) Date of Patent: Jan. 17, 2017

(54) WIRE CONNECTION TERMINAL HOLDING STRUCTURE

(71) Applicants: SWITCHLAB INC., New Taipei (TW); SWITCHLAB (SHANGHAI) CO., LTD., Shanghai (CN)

(72) Inventors: Chih-Yuan Wu, New Taipei (TW); Chih-Kun Hsiao, New Taipei (TW)

(73) Assignees: Switchlab Inc., New Taipei (TW); Switchlab (Shanghai) Co., Ltd., Shanghai (CN)

( * ) Notice: Subject to any disclaimer, the term of this patent is extended or adjusted under 35 U.S.C. 154(b) by 0 days.

(21) Appl. No.: 14/995,327

(22) Filed: Jan. 14, 2016

(65) Prior Publication Data

US 2016/0240970 A1 Aug. 18, 2016

(30) Foreign Application Priority Data

Feb. 17, 2015 (TW) ..... 104202856 U

(51) Int. Cl.

| | |
|---|---|
| ***H01R 11/22*** | (2006.01) |
| ***H01R 13/635*** | (2006.01) |
| ***H01R 4/48*** | (2006.01) |
| ***H01R 24/20*** | (2011.01) |
| *H01R 12/57* | (2011.01) |
| *H01R 101/00* | (2006.01) |

(52) U.S. Cl.

CPC ..... *H01R 13/635* (2013.01); *H01R 4/4836* (2013.01); *H01R 24/20* (2013.01); *H01R 12/57* (2013.01); *H01R 2101/00* (2013.01)

(58) Field of Classification Search

CPC ..... H01R 13/193; H01R 13/20; H01R 4/4818; H01R 4/4836; H01R 4/4845; H01R 4/489; G01R 1/04; H05K 7/1007; H05K 7/1084

USPC ..... 439/268, 438, 439, 159

See application file for complete search history.

(56) References Cited

U.S. PATENT DOCUMENTS

| | | | | |
|---|---|---|---|---|
| 2,713,668 A * | 7/1955 | Gibilisco | ..... | H01R 4/4836 439/438 |
| 3,652,811 A * | 3/1972 | Barney | ..... | H01H 1/5844 200/284 |
| 3,668,610 A * | 6/1972 | Flanagan | ..... | H01R 13/20 439/268 |
| 4,973,263 A * | 11/1990 | Nielsen | ..... | G05B 19/0423 439/438 |

(Continued)

*Primary Examiner* — Abdullah Riyami
*Assistant Examiner* — Vladimir Imas
(74) *Attorney, Agent, or Firm* — Rosenberg, Klein & Lee

(57) ABSTRACT

A wire connection terminal holding structure includes an insulation outer case and a conductive holding frame disposed in the outer case. The outer case is formed with a wire socket and a perforation. The holding frame includes an electrical connection member and elastic members respectively disposed on two sides of the electrical connection member. Each of the elastic members extends to form a holding section. The holding sections extend toward each other to define therebetween a holding mouth corresponding to the wire socket and a wire insertion space positioned between the holding sections in communication with the holding mouth. A split is formed between top edges of the holding sections. A pushbutton is disposed in the perforation for pushing and opening/closing the holding mouth. A stop section is disposed on at least one of the holding sections of the elastic members for blocking the split.

36 Claims, 5 Drawing Sheets

(56) References Cited

U.S. PATENT DOCUMENTS 5,722,925 A * 3/1998 Kameyama ..... H01R 13/113 600/453
5,871,379 A * 2/1999 Tanaka ..... H01R 13/187 439/700
5,975,940 A * 11/1999 Hartmann ..... H01R 4/4818 439/441
6,068,505 A * 5/2000 Sai ..... H01R 4/182 439/422
6,570,306 B2 * 5/2003 Henrici ..... H01R 4/4818 313/318.01
7,004,781 B2 * 2/2006 Walter ..... H01R 4/4836 439/268
7,175,469 B1 * 2/2007 Daily ..... H01R 4/4818 439/441
7,255,592 B1 * 8/2007 Tseng ..... H01R 4/22 439/439
7,384,319 B2 * 6/2008 Kirstein ..... H01R 4/4818 439/439
7,503,786 B2 * 3/2009 Kato ..... H01R 13/193 439/239
7,507,106 B2 * 3/2009 Keswani ..... H01R 4/4818 439/439
7,513,793 B2 * 4/2009 Horst ..... H01R 4/4818 439/427
7,753,718 B2 * 7/2010 Bethurum ..... H01R 4/4818 439/293
7,794,268 B2 * 9/2010 Breen, IV ..... H01R 4/22 439/439
7,997,915 B2 * 8/2011 Pueschner ..... H01R 4/4818 439/268
8,187,023 B1 * 5/2012 Chen ..... H01R 4/22 439/439
8,262,405 B1 * 9/2012 Bishop ..... H01R 4/4845 439/439
8,328,586 B2 * 12/2012 Bies ..... H01R 4/4836 439/725
8,550,838 B2 * 10/2013 Osagle ..... H01R 4/4818 439/441
8,568,157 B2 * 10/2013 Bishop ..... H01R 4/2433 439/389
8,591,271 B2 * 11/2013 Bies ..... H01R 4/4836 439/725
8,636,523 B2 * 1/2014 Nagasaki ..... H01R 4/2404 439/439
8,882,533 B2 * 11/2014 Brandberg ..... H01R 13/193 439/441
8,944,843 B2 * 2/2015 Keswani ..... H01R 4/4836 439/441
8,968,022 B2 * 3/2015 Mostoller ..... H01R 4/4836 439/438
9,136,641 B2 * 9/2015 Bishop ..... H01R 4/4836
9,263,822 B2 * 2/2016 Wu ..... H01R 13/2407
9,306,297 B2 * 4/2016 Bishop ..... H01R 4/4818
9,331,427 B2 * 5/2016 Tedeschi ..... H01R 13/629
9,337,556 B2 * 5/2016 Rask ..... F04D 13/0686
9,343,828 B2 * 5/2016 Bishop ..... H01R 4/4818
2011/0250775 A1 * 10/2011 Bies ..... H01R 4/4836 439/296
2011/0250803 A1 * 10/2011 Bies ..... H01R 4/4836 439/752.5
2012/0064780 A1 * 3/2012 Wu ..... H01R 9/2475 439/712
2014/0213093 A1 * 7/2014 Tal ..... H01R 13/20 439/352
2014/0242833 A1 * 8/2014 Mostoller ..... H01R 4/4836 439/438
2015/0064950 A1 * 3/2015 Wu ..... H01R 13/2407 439/259
2016/0134054 A1 * 5/2016 Wu ..... H01R 4/4836 439/660

* cited by examiner

WIRE CONNECTION TERMINAL HOLDING STRUCTURE

BACKGROUND OF THE INVENTION

1. Field of the Invention

The present invention relates generally to a wire connection terminal holding structure for electrically connecting with a wire contact of an electronic component, and more particularly to a wire connection terminal holding structure, which can prevent the wire from extending out of the wire connection terminal. The wire connection terminal holding structure also serves to guide the wire to successfully insert into the wire connection terminal to be held therein.

2. Description of the Related Art

A wire connection terminal is also referred to as a connector. The wire connection terminal is mainly used to connect the electrical wires between electronic components or connect the wire contacts of the electronic components onto a circuit board. The electronic components include resistors, capacitors, inductors, LED, transformers, liquid crystal panels, touch panels, etc. Accordingly, the wire connection terminal serves to transmit power or electronic signals to facilitate layout and service of the internal circuit boards and electronic components of the electronic products and apparatuses.

Currently, there are various wire connection terminals on the market. As shown in FIG. 1, a conventional wire connection terminal generally has a plastic-made insulation outer case 1*a* and a metal-made conductive holding frame 2*a* enclosed in the outer case 1*a*. The front end of the outer case 1*a* is formed with wire sockets 11*a* for external wires to insert in. In addition, the top section of the outer case 1*a* is formed with perforations 12*a*. The holding frame 2*a* includes an electrical connection member 20*a* exposed to the bottom side of the outer case 1*a* and two elastic members 21*a*, 22*a* respectively disposed on two sides of the electrical connection member 20*a*. The electrical connection member 20*a* can be soldered on a circuit board to electrically connect the wire connection terminal with the circuit board. Each of the elastic members 21*a*, 22*a* has a plate-shaped holding sections 211*a*, 221*a*. The holding sections 211*a*, 221*a* extend toward each other to define therebetween a holding mouth 24*a* corresponding to the wire socket 11*a*. The bottom of the space between the holding sections 211*a*, 221*a* is blocked by the electrical connection member 20*a*. However, the top of the space between the holding sections 211*a*, 221*a* is not shielded by any structure and a split 25*a* is formed between the holding sections 211*a*, 221*a* and the holding mouth 24*a*. In addition, an end mouth 241*a* is formed between the top section of the holding mouth 24*a* and the split 25*a*. A pushbutton 3*a* is movably disposed in the perforation 12*a* corresponding to the respective holding sections 211*a*, 221*a*.

The external wire can be inserted through the wire socket 11*a* of the front end of the outer case 1*a* into the holding mouth 24*a*. By means of the elastic force of the holding sections 211*a*, 221*a*, the wire can be securely held in the holding mouth 24*a*. Under such circumstance, the wire can be securely held by the holding frame 2*a* of the wire connection terminal to conduct current and is prevented from being unexpectedly extracted out of the holding frame 2*a*. When pressing the pushbutton 3*a*, the pushbutton 3*a* is moved downward to push and open the holding mouth 24*a* so as to release the wire from the holding of the holding mouth 24*a*.

However, when the wire is inserted into the wire socket 11*a*, in case the front insertion end of the wire fails to keep straight, the wire is quite apt to deflect and extend in a direction to a region outside the holding mouth 24*a*. As aforesaid, the bottom of the space between the holding sections 211*a*, 221*a* is blocked by the electrical connection member 20*a* to prevent the wire from deflecting and extending out of the holding mouth 24*a*. However, the split 25*a* between the tops of the holding sections 211*a*, 221*a*, the end mouth 241*a* and a region below the pushbutton 3*a* are all free from any structure or mechanism for preventing the wire from deflecting and extending out of the holding frame 2*a*. As a result, at the insertion stage, in case the wire is not properly forced or the front end of the wire is not straight, the wire is especially apt to deflect and extend through the split 25*a*, the end mouth 241*a* or the region below the pushbutton 3*a* out of the holding frame 2*a*. Accordingly, it is impossible to truly hold the wire in the holding mouth 24*a*. As a result, the wire connection terminal will deteriorate or lose its wire-holding and electrical conduction function and anti-extraction ability. This leads to increase of uncertainty in operation.

Moreover, in case a wire with a large diameter is inserted into the wire connection terminal, the holding mouth 24*a* must be opened to a gap sufficient for the large-diameter wire to insert in and extract out. Therefore, it is necessary to apply a greater press force to the pushbutton 3*a* to press down the pushbutton 3*a* by a deeper height or it is necessary to use a sharp slender tool to help in opening the holding mouth 24*a*. The operation is quite inconvenient. Furthermore, the respective elastic members 21*a*, 22*a* are not interconnected with each other. Accordingly, in the condition that the holding sections 211*a*, 221*a* are long-term pushed by the wire and repeatedly pressed by the pushbutton 3*a* to open the holding mouth 24*a*, the respective elastic members 21*a*, 22*a* and the holding sections 211*a*, 221*a* are apt to outward expand or deform. As a result, the holding mouth 24*a* will lose its original elastic wire-holding function, especially to a slenderer wire.

Moreover, in the conventional wire connection terminal, the holding sections 211*a*, 221*a* extending from the elastic members 21*a*, 22*a* to the holding mouth 24*a* are all formed with a once inward folded configuration. In this case, in order to fully adapt the wire connection terminal to various wires with different diameters ranging from a large scale to a small scale, the inward folding angle must be enlarged so as to securely hold the slenderer wire. However, on the other hand, this will greatly increase the resistance of the holding sections 211*a*, 221*a* or the holding mouth 24*a* against the insertion of the wire. As a result, it will become uneasy to insert the wire into the holding frame. This is not what we expect.

It is therefore tried by the applicant to provide a wire connection terminal holding structure to improve the shortcomings existing in the conventional wire connection terminal.

SUMMARY OF THE INVENTION

It is therefore a primary object of the present invention to provide a wire connection terminal holding structure. During the insertion process of the wire, the wire connection terminal holding structure is able to prevent the wire from deflecting and extending out of the conductive holding frame. Moreover, the wire connection terminal holding structure is able to fully guide the wire to successfully insert into the wire connection terminal to be held therein. The wire connection terminal holding structure overcomes the shortcoming of the conventional wire connection terminal that when inserted into the wire connection terminal, the wire is apt to deflect and extend out of the conductive holding frame or the holding mouth. In this case, the conventional wire connection terminal will deteriorate or lose its wire-holding and electrical conduction function and anti-extraction ability.

To achieve the above and other objects, the wire connection terminal holding structure of the present invention includes an insulation outer case and a conductive holding frame disposed in the outer case. The outer case is formed with a wire socket and a perforation. The holding frame includes an electrical connection member and elastic members respectively disposed on two sides of the electrical connection member. The elastic members extend to form at least two holding sections facing each other. The holding sections define therebetween a holding mouth corresponding to the wire socket and a wire insertion space formed between the holding sections in communication with the holding mouth. The wire insertion space has a split directed to one side of the wire insertion space distal from the electrical connection member. An end mouth is formed between the holding mouth and the split and positioned on a top portion of the split. A pushbutton is movably disposed in the perforation for pushing and opening/closing the holding mouth. A stop section is disposed on the holding section of at least one of the first and second elastic members for blocking the split. The height difference between the electrical connection member and the end mouth is at least equal to or larger than the height difference between the electrical connection member and the stop section. Accordingly, the section of the wire insertion space that communicates with the holding mouth through the split fully corresponds to the region of the holding mouth between the electrical connection member and the end mouth.

Accordingly, the height of the end mouth is at least fully flush with or higher than the height of the stop section, whereby the end mouth on the top section of the holding mouth is fully positioned outside the region through which the wire insertion space correspondingly communicates with the holding mouth below the stop section. Therefore, when the wire is inserted through the wire socket into the wire insertion space between the elastic members, the stop section can laterally prevent the wire from deflecting and guide the wire to successfully extend through the space between the holding sections and the split into the holding mouth. Therefore, the wire is prevented from laterally deflecting to the end mouth to extend out of the conductive holding frame. In this case, the wire insertion error ratio in use of the wire connection terminal holding structure of the present invention is lowered.

In the above wire connection terminal holding structure, a connection member is disposed on one of the elastic members. The connection member extends between the elastic members. The connection member has an elastic arm. The elastic arm extends to the perforation and is bridged between the holding sections. The pushbutton is disposed on the elastic arm and separated from the outer case. The pushbutton is elastically movably positioned in the perforation. The elastic arm is formed with a curved section. The curved section is bent to extend into a part of the split between the stop section and the connection member to block the part of the split. Moreover, the curved section has an inward arched face for guiding the inserted wire to successfully enter the holding mouth.

It is a further object of the present invention to provide a wire connection terminal holding structure, which can open the holding mouth to a large extent by means of slightly pressing the pushbutton. This overcomes the shortcoming of the conventional wire connection terminal that it is necessary to apply a greater press force to the pushbutton to press down the pushbutton by a deeper height or it is necessary to use a sharp slender tool to help in opening the holding mouth.

To achieve the above and other objects, in the wire connection terminal holding structure, the holding sections are respectively formed with guide slopes at the end mouth. The guide slopes are directed to the perforation. The pushbutton is formed with oblique push faces directed to the guide slopes. A notch is defined between the end mouth and the guide slopes. The oblique push faces are interconnected to form a ridge section extending to the end mouth to block the notch. The ridge section has a stop face directed to one side of the notch.

Accordingly, the oblique push faces of the bottom section of the pushbutton downward extend and connect with each other to form the ridge section. The oblique push faces define a substantially triangular stop face on the cross section of the ridge section. In addition, the oblique push faces and the ridge section together form a V-shaped configuration attached to the two guide slopes. When the wire extends to the position where the oblique push faces of the bottom section of the pushbutton and the guide slopes are positioned, the oblique push faces are attached to the guide slopes and the stop face is interposed between the bottom section of the pushbutton and the guide slopes, whereby the wire is further prevented from extending through the notch out of the holding frame. As aforesaid, the oblique push faces of the pushbutton are attached to the guide slopes of the holding sections and the ridge section abuts against the bottom ends of the guide slopes. Therefore, when pressing the pushbutton, the press/push force of the pushbutton is converted into lateral component force to press the two guide slopes and open the holding mouth to a large extent. In this case, the wire can successfully enter the holding mouth to be held by the holding sections or the wire can be extracted out of the holding mouth between the holding sections. Therefore, when inserting and extracting the wire, the unit press distance of the pushbutton can more efficiently cause larger open extent of the holding mouth or the holding sections. Moreover, when the pushbutton is pressed down to a maximum extent so as to open the holding mouth to a maximum gap for a wire with a largest diameter to be extracted from the holding mouth, the height or space reserved by the bottom section of the pushbutton is still sufficient for the wire with the largest diameter to pass through. Therefore, the present invention can be more conveniently operated.

It is still a further object of the present invention to provide a wire connection terminal holding structure, which can securely and integrally connect the respective elastic members with each other to overcome the shortcoming of the conventional wire connection terminal that the elastic members and the holding sections are apt to deform under the press of the pushbutton and the holding mouth is apt to lose its elastic wire holding function.

To achieve the above and other objects, in the wire connection terminal holding structure, one of the elastic members and the connection member are assembled and connected with each other by means of a latch member and a latch recess. Accordingly, in the condition that the holding sections of the first and second elastic members are frequently pressed by the pushbutton, by means of the latch member and the latch recess, the elastic members can be still securely latched with each other and the interval between the elastic members can keep unchanged. This ensures that the holding mouth can elastically hold the wire and further enhances the durability of the wire connection terminal and prolongs the lifetime thereof.

In the above wire connection terminal holding structure, the latch member is formed with a recessed section, while the latch recess is formed with a protrusion section for latching in the recessed section. Accordingly, the latch member and the latch recess can be more securely assembled and connected with each other.

In the above wire connection terminal holding structure, the connection member has a bending end mating with one of the elastic members. The latch member and the latch recess are respectively formed on the bending end and one of the elastic members. Accordingly, the direction in which the latch member is latched into the latch recess is different from the swinging direction of the elastic arm. Under such circumstance, the swinging action force of the elastic arm will not affect the latch member so that the assembling and locating security between the latch member and the latch recess can be ensured.

It is still a further object of the present invention to provide a wire connection terminal holding structure, which can properly reduce the resistance against the opening of the holding mouth so as to prevent a slenderer wire from deflecting and extending out of the holding mouth due to excessively great resistance.

To achieve the above and other objects, in the wire connection terminal holding structure, the holding structures between the holding sections and the holding mouth are formed with inward folded sections, which are at least twice inward folded to achieve a complete holding gap. The inward folded sections have multistage smaller inward folding angles so that the resistance against unit stretching angle of the holding mouth is reduced. Moreover, in this case, after stretched, the possibility of elastic fatigue of the holding sections is minimized.

The present invention can be best understood through the following description and accompanying drawings, wherein:

DETAILED DESCRIPTION OF THE PREFERRED EMBODIMENTS

Figure 1:
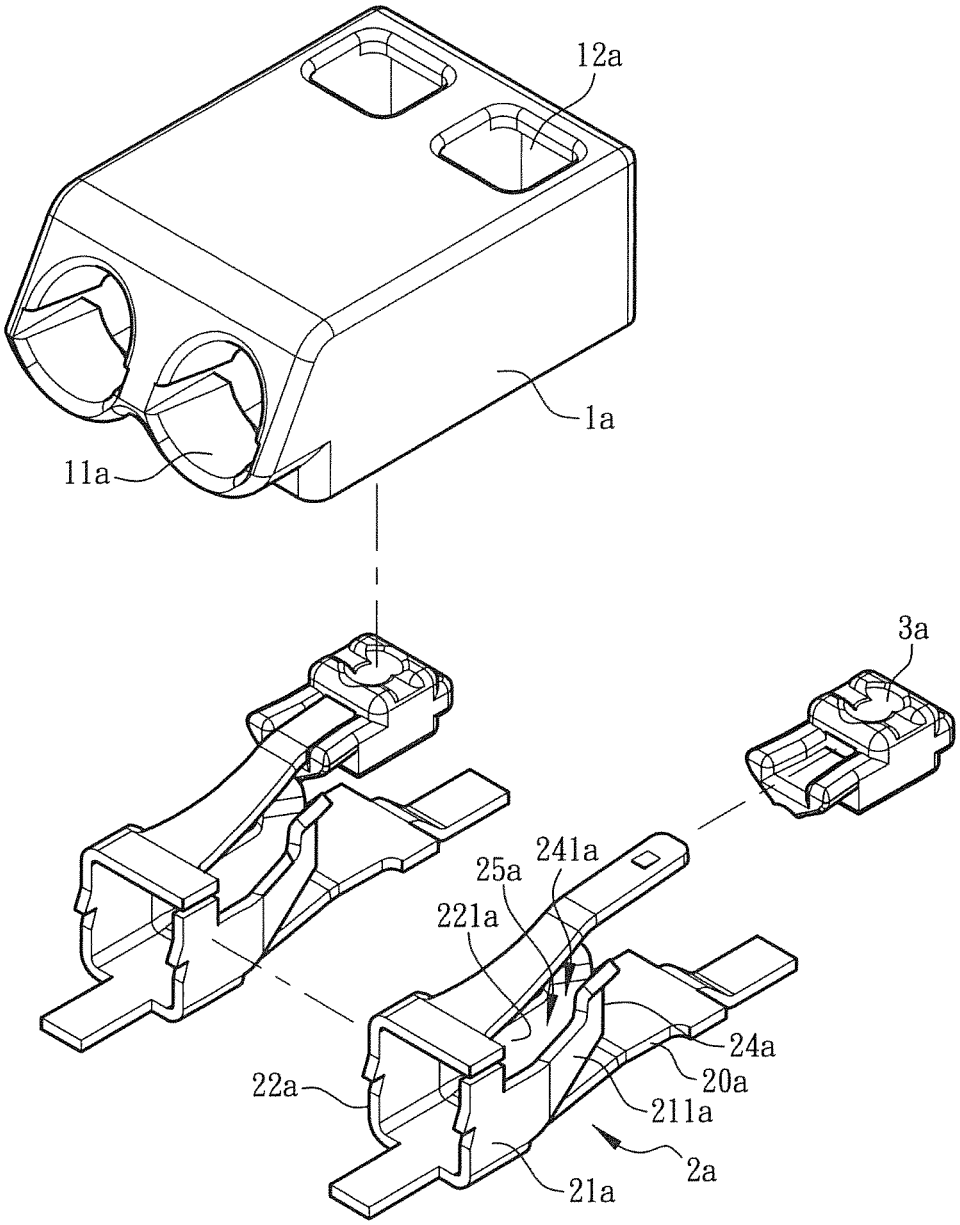
Fig. 1 PRIOR ART
FIG. 1 is a perspective exploded view of a conventional wire connection terminal.
Figure 2:
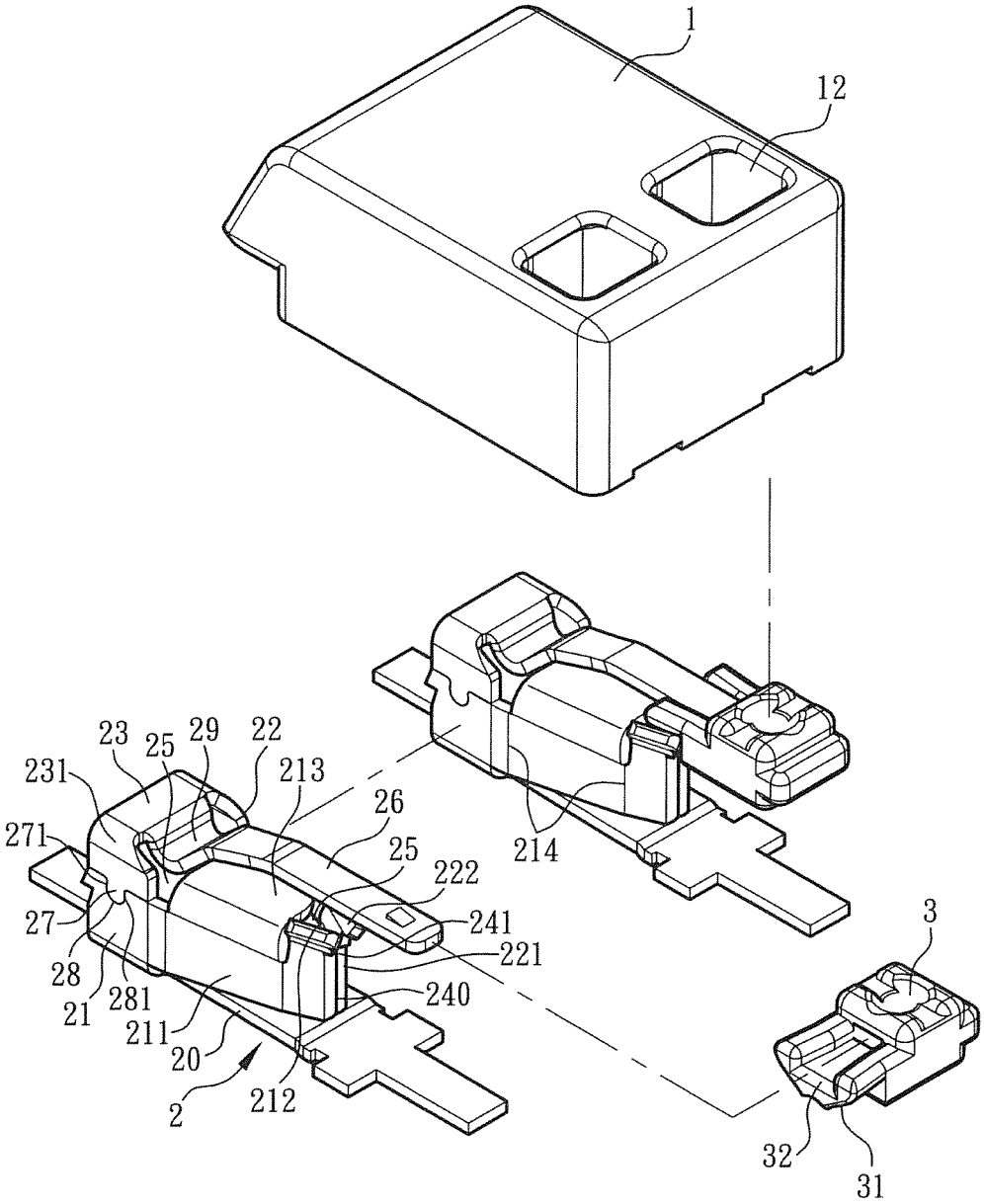
FIG. 2 is a perspective exploded view of a preferred embodiment of the present invention.
Figure 3:
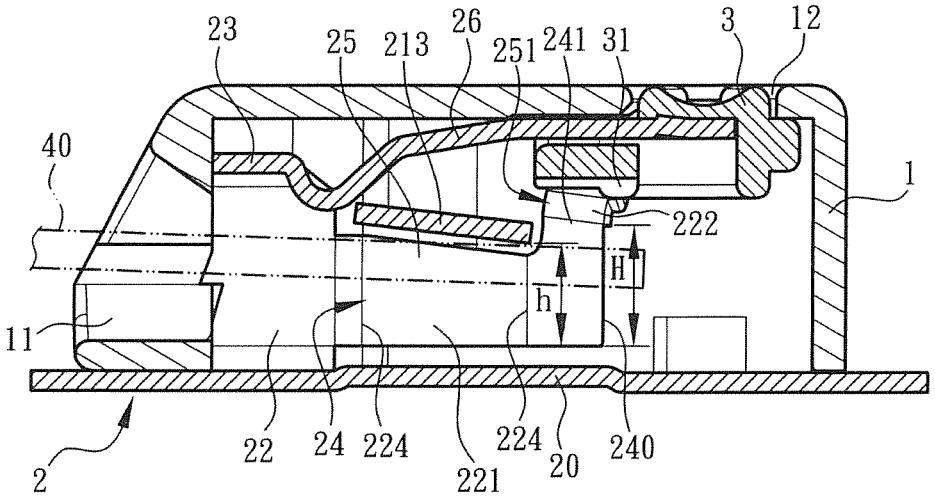
FIG. 3 is a side sectional view of the preferred embodiment of the present invention according to FIG. 2.
Figure 4:
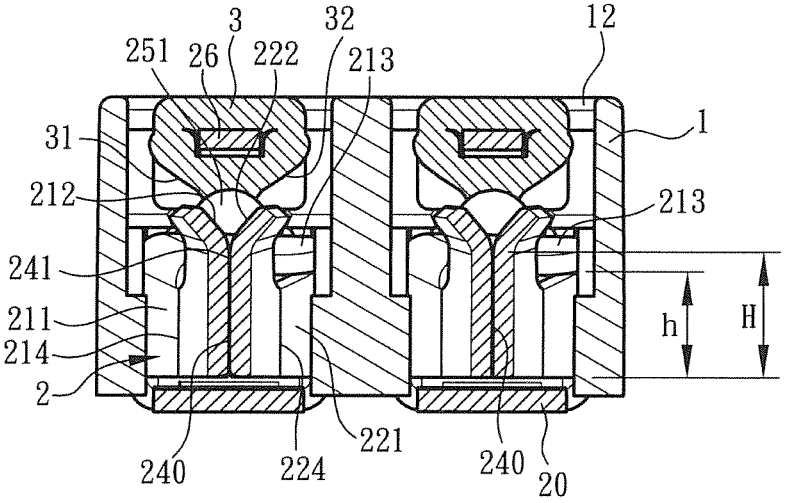
FIG. 4 is a rear sectional view of the preferred embodiment of the present invention according to FIG. 2.

Please refer to FIGS. 2 to 4. FIG. 2 is a perspective exploded view of a preferred embodiment of the present invention. FIG. 3 is a side sectional view of the preferred embodiment of the present invention according to FIG. 2. FIG. 4 is a rear sectional view of the preferred embodiment of the present invention according to FIG. 2. The wire connection terminal holding structure of the present invention includes a plastic-made insulation outer case 1 and a metal-made conductive holding frame 2 disposed in the outer case 1. One side of the outer case 1 is formed with at least one wire socket 11. A top section of the outer case 1 is formed with at least one perforation 12. The holding frame 2 includes an electrical connection member 20 and elastic members respectively disposed on two sides of the electrical connection member 20. In this embodiment, the elastic members are, but not limited to, a first elastic member 21 and a second elastic member 22 for illustration purposes only.

A connection member 23 is disposed on the first elastic member 21 or the second elastic member 22 and extends between the first and second elastic members 21, 22. In this embodiment, the connection member 23 is disposed on a top section of the second elastic member 22 and extends from the second elastic member 22 to the first elastic member 21. Accordingly, the electrical connection member 20, the connection member 23, the first elastic member 21 and the second elastic member 22 are arranged in the form of a rectangular frame. A bottom face of the electrical connection member 20 is exposed to a bottom side of the outer case 1. The electrical connection member 20 can be soldered on an external circuit board to connect the wire connection terminal with the circuit board.

The first and second elastic members 21, 22 are bent inward toward each other and extend to respectively form plate-shaped holding sections 211, 221. The holding sections 211, 221 define therebetween a wire insertion space 24 corresponding to the wire socket 11. The free ends of the holding sections 211, 221 are converged to form a holding mouth 240 and a split 25 between top edges of the holding sections 211, 221. An end mouth 241 is formed between the holding mouth 240 and the split 25 and positioned on a top portion of the split 25.

A pushbutton 3 is movably disposed in the perforation 12 of the top section of the outer case 1. The pushbutton 3 serves to push and open/close the holding mouth 240. To speak more specifically, an elastic arm 26 is disposed on the connection member 23. The elastic arm 26 extends to the perforation 12 of the top section of the outer case 1 and is bridged between the holding sections 211, 221. The pushbutton 3 is disposed at a free end of the elastic arm 26 and separated from the outer case 1. The pushbutton 3 is elastically movably positioned in the perforation 12. The conductive holding frame 2 can be made of metal plate material by bending. Therefore, the holding sections 211, 221 of the first and second elastic members 21, 22 and the elastic arm 26 all have elasticity.

The end mouth 241 of the holding mouth 240 is formed with guide slopes 212, 222 directed to the perforation 12. The guide slopes 212, 222 diverge from each other to form a V-shaped configuration. Two sides of the bottom section of the pushbutton 3 are respectively formed with oblique push faces 31, 32 directed to the guide slopes 212, 222. The oblique push faces 31, 32 are arranged in a V-shaped form and correspondingly positioned between the guide slopes 212, 222.

A stop section 213 is disposed on at least one of the holding sections 211, 221 of the first and second elastic members 21, 22 for blocking the split. In this embodiment, the stop section 213 extends from the top section of the holding section 211 of the first elastic member 21 to the second elastic member 22. Alternatively, each of the holding sections 211, 221 of the first and second elastic members 21, 22 can have a stop section. The stop sections of the first and second elastic members 21, 22 extend toward each other. In a preferred embodiment, the height difference H between the electrical connection member 20 and the end mouth 241 is at least equal to or larger than (not smaller than) the height difference h between the electrical connection member 20 and the stop section 213. Accordingly, the position of the top section of the holding mouth 240 (the end mouth 241) is not lower than the shielding height of the stop section 213.

In a preferred embodiment, the elastic arm 26 is formed with a curved section 29 in a position where the elastic arm 26 is connected with the connection member 23. The curved section 29 is curved toward the interior of the conductive holding frame 2. The curved section 29 is bent into a part of the split 25 between the stop section 213 and the connection member 23. The curved section 29 not only serves to shield the part of the split 25, but also has a curved face to guide the wire 40 inserted into the conductive holding frame 2 from the wire socket 11 to successfully go into the wire insertion space 24 and the holding mouth 240.

In use, the contact of the wire 40 connecting with an electronic component such as a resistor, a capacitor, an inductor, an LED, a transformer, a liquid crystal panel or a touch panel can be inserted through the wire socket 11 into the outer case 1. At this time, the wire 40 will touch and push the holding sections 211, 221 or the holding mouth 240 of the first and second elastic members 21, 22 to force the holding sections 211, 221 or the holding mouth 240 to elastically move toward the outer side of the conductive holding frame 2 so as to open the holding mouth 240. When the wire 40 passes through the holding mouth 240, the holding sections 211, 221 provide elastic force for the holding mouth 240 to hold the wire 40 so as to locate the wire 40 in the holding mouth 240.

During this period, the stop sections 213 on the holding sections 211, 221 can prevent the wire 40 from extending through the split 25 out of the conductive holding frame 2. Moreover, the height difference H between the end mouth 241 of the holding mouth 240 that may communicate with the split 25, and the electrical connection member 20 is at least such increased as to not to smaller than the height difference h between the stop sections 213 and the electrical connection member 20. In this case, the end mouth 241 is fully shielded by the stop sections 213 and is positioned outside a regulated region through which the wire insertion space 24 correspondingly communicates with the holding mouth 240. Therefore, when the external wire 40 is inserted through the wire socket 11 between the first and second elastic members 21, 22, the stop sections 213 serve to prevent the wire 40 from deflecting and extending through the split 25 or the end mouth 241 out of the conductive holding frame 2 or the true position of the holding mouth 240. Accordingly, the wire 40 is guided to successfully insert into the holding mouth 240.

When it is desired to extract the wire 40 out of the wire connection terminal, the pushbutton 3 can be pressed to make the oblique push faces 31, 32 touch and drive the guide slopes 212, 222 of the first and second elastic members 21, 22. The oblique push faces 31, 32 of the pushbutton 3 move along the guide slopes 212, 222 to push and stretch open the holding mouth 240. That is, the holding sections 211, 221 of the first and second elastic members 21, 22 are forced to elastically stretch toward the outer side of the conductive holding frame 2 to drivingly open the holding mouth 240. At this time, the wire 40 can be successfully released from the holding sections 211, 221 or taken out from the holding mouth 240.

Accordingly, the wire 40 is prevented from extending out of the conductive holding frame 2 or holding mouth 240 of the wire connection terminal and the wire 40 can be guided to successfully insert into the holding mouth 240 to be held by the holding sections 211, 221. This overcomes the shortcoming of the conventional wire connection terminal that the external wire is very apt to laterally deflect to extend out of the conductive holding frame or the holding mouth of the wire connection terminal. In this case, the conventional wire connection terminal will deteriorate or lose its wire-holding and electrical conduction function and anti-extraction ability. The present invention is advantageous over the conventional wire connection terminal and the error ratio in use of the present invention is lowered.

As shown in FIG. 2, in another preferred embodiment, the first elastic member 21 and the connection member 23 are assembled with each other by means of a latch member 27 and a latch recess 28. The latch member 27 is formed with a recessed section 271, while the latch recess 28 is formed with a protrusion section 281 for latching in the recessed section 271. This can enhance the assembling and locating security between the latch member 27 and the latch recess 28. To speak more specifically, the latch member 27 is formed on the connection member 23 and has a circular configuration. The recessed section 271 is positioned on two sides of a junction between the circular latch member 27 and the connection member 23. The latch recess 28 is formed on the top section of the first elastic member 21 and also has a circular configuration. The protrusion section 281 is positioned in a position where the circular latch recess 28 is aligned with the recessed section 271 of the circular latch member 27.

Accordingly, in the condition that the holding sections 211, 221 of the first and second elastic members 21, 22 are frequently pressed by the pushbutton 3 or long-term pushed by the inserted wire 40, by means of the latch member 27 and the latch recess 28, the first and second elastic members 21, 22 can be still securely latched with each other and the stretching interval between the first and second elastic members 21, 22 can be kept unchanged. This prevents unexpected outward expansion, twisting or deformation from taking place between the electrical connection member 20, the connection member 23 and the first and second elastic members 21, 22 so as to ensure that the holding mouth 240 can elastically hold the wire 40 and further enhance the durability of the wire connection terminal and prolong the lifetime thereof.

In a modified embodiment, the connection member 23 has a bending end 231 mating with the first elastic member 21. The latch member 27 and the latch recess 28 are respectively formed on the bending end 231 and the first elastic member 21. Accordingly, the direction in which the latch member 27 is latched into the latch recess 28 is different from the up and down swinging direction of the elastic arm 26. Under such circumstance, the swinging action force of the elastic arm 26 will not affect the latch member 27 so that the assembling and locating security between the latch member 27 and the latch recess 28 can be ensured.

Figure 5:
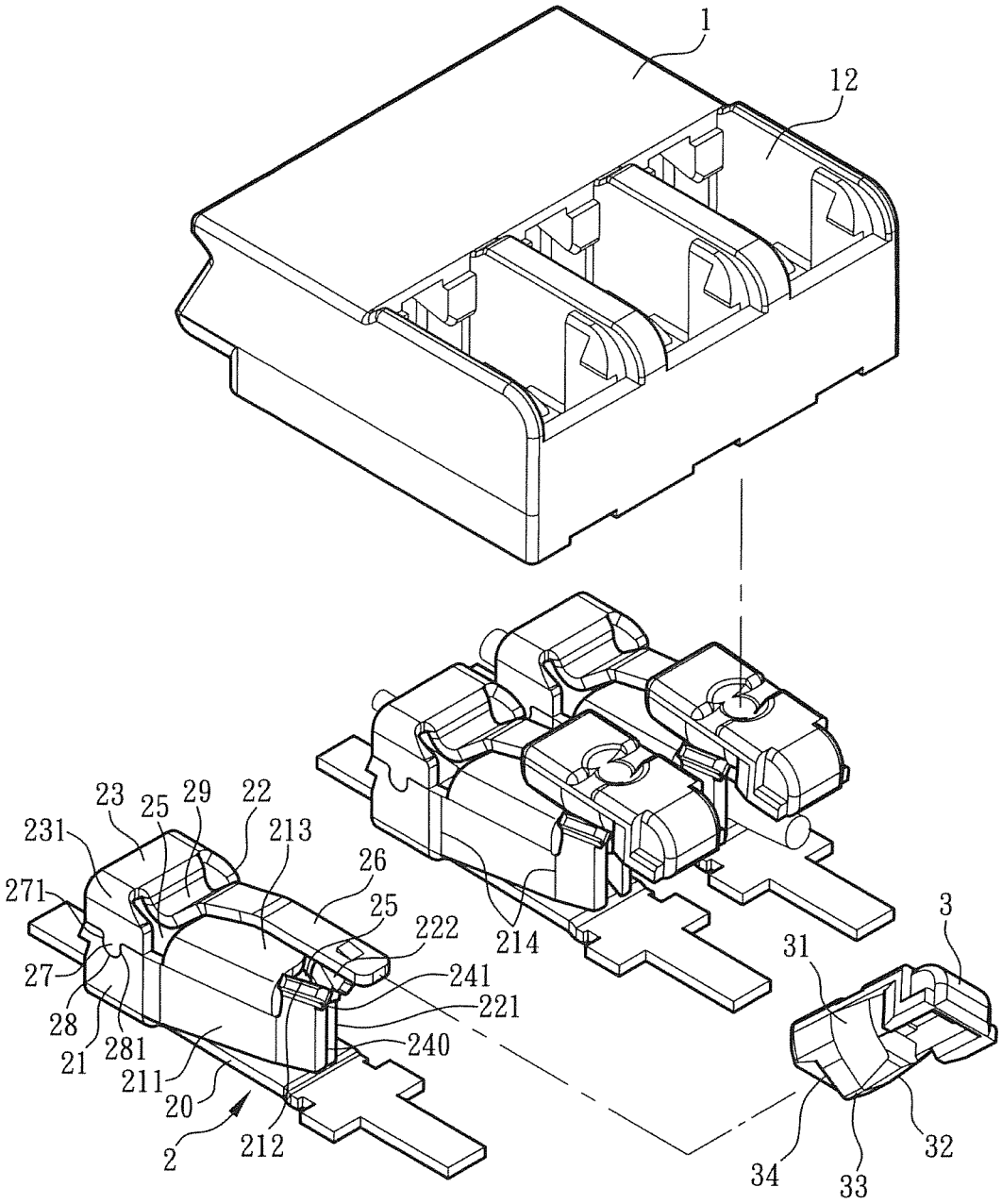
FIG. 5 is a perspective exploded view of another embodiment of the present invention according to FIG. 2.
Figure 6:
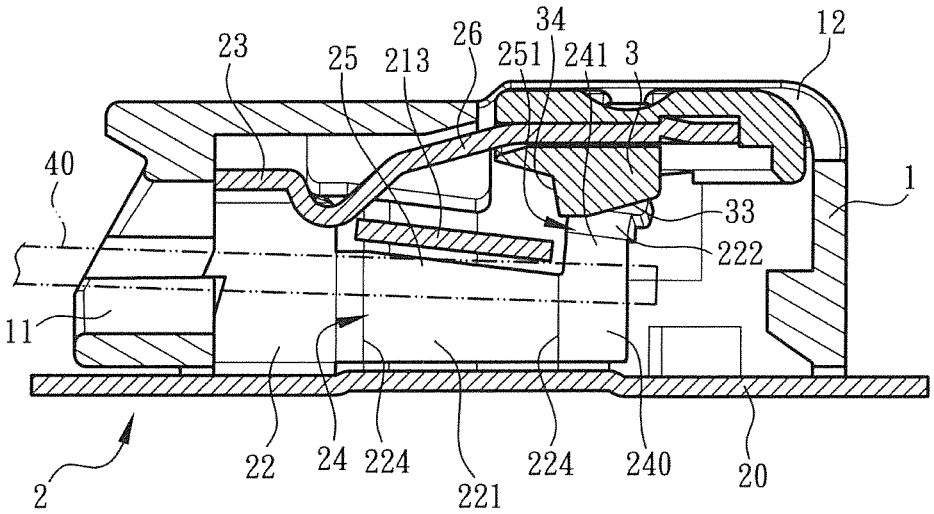
FIG. 6 is a side sectional view of the other embodiment of the present invention according to FIG. 5.
Figure 7:
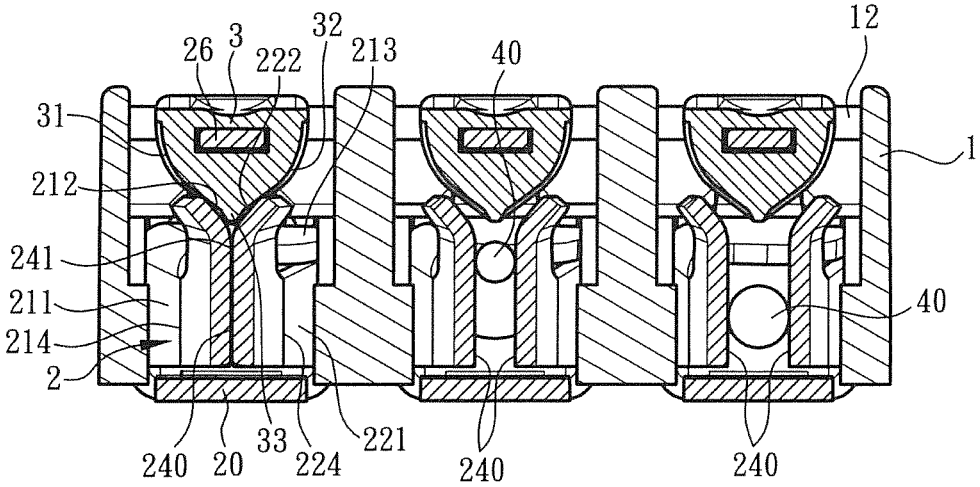
FIG. 7 is a rear sectional view of the other embodiment of the present invention according to FIG. 5.

Please now refer to FIGS. 5 to 7. In another embodiment, a notch 251 is formed between the end mouth 241 and the guide slopes 212, 222 (with reference to FIGS. 3 and 4). The bottom ends of the respective oblique push faces 31, 32 are interconnected to form a ridge section 33 extending to a position close to the end mouth 241 to block the notch 251. The ridge section 33 has a stop face 34 directed to one side of the notch 251. Accordingly, the oblique push faces 31, 32 of the bottom section of the pushbutton 3 downward extend and connect with each other to form the ridge section 33. The oblique push faces 31, 32 define a substantially triangular stop face 34 on the cross section of the ridge section 33. In addition, the oblique push faces 31, 32 and the ridge section 33 together form a V-shaped configuration attached to the two guide slopes 212, 222. When the wire 40 extends to the position where the oblique push faces 31, 32 of the bottom section of the pushbutton 3 and the guide slopes 212, 222 are positioned, the oblique push faces 31, 32 are attached to the guide slopes 212, 222 and the stop face 34 is interposed between the bottom section of the pushbutton 3 and the guide slopes 212, 222, (that is, the stop face 34 blocks the notch 251 between the split 25 and the end mouth 241), whereby the wire 40 is further prevented from extending through the notch 251 out of the holding mouth 240.

As aforesaid, the oblique push faces 31, 32 of the pushbutton 3 are attached to the guide slopes 212, 222 of the holding sections 211, 221 and the ridge section 33 abuts against the bottom ends of the guide slopes 212, 222. Therefore, when pressing the pushbutton 3, the press/push force of the pushbutton 3 is converted into lateral component force to press the two guide slopes 212, 222 and overcome the elastic force of the holding sections 211, 221 directed to each other. Accordingly, the holding mouth 240 can be opened to a large extent, permitting the wire 40 to successfully enter the holding mouth 240 to be held therein or permitting the wire 40 to be extracted out of the holding mouth 240.

Accordingly, when inserting and extracting the wire 40, the unit press distance of the pushbutton 3 can more efficiently cause larger open extent of the holding mouth 240 or the holding sections 211, 221. Moreover, when the pushbutton 3 is pressed down to a maximum extent so as to open the holding mouth 240 to a maximum gap for a wire with a largest diameter to be extracted from the holding mouth 240, the height or space reserved by the bottom section of the pushbutton 3 is still sufficient for the wire 40 with the largest diameter to pass through. This overcomes the shortcoming of the conventional wire connection terminal that it is necessary to apply a greater press force to the pushbutton to press down the pushbutton by a deeper height or it is necessary to use a sharp slender tool to help in opening the holding mouth. Therefore, the present invention can be more conveniently operated.

Further referring to FIGS. 2 to 7, the holding sections 211, 221 of the first and second elastic members 21, 22 extend to define the holding mouth 240. The holding sections 211, 221 can further have inward folded sections 214, 224, which are at least twice inward folded to achieve a complete holding gap. This can distribute the elastic holding force provided by the entire holding gap and reduce the necessary elastic resistance against unit stretching extent. Under such circumstance, the resistance against the insertion of a slenderer wire 40 can be minified to prevent the wire 40 from deflecting due to excessively great resistance.

The above embodiments are only used to illustrate the present invention, not intended to limit the scope thereof. Many modifications of the above embodiments can be made without departing from the spirit of the present invention.

What is claimed is:

1. A wire connection terminal holding structure comprising an insulation outer case and a conductive holding frame disposed in the outer case, the outer case being formed with a wire socket and a perforation, the holding frame including an electrical connection member and elastic members respectively disposed on two sides of the electrical connection member, each of the elastic members extending to form a holding section, the holding sections of the elastic members extending toward each other to define therebetween a wire insertion space and a holding mouth corresponding to the wire socket, a split being formed between top edges of the holding sections, a pushbutton being movably disposed in the perforation for pushing and opening/closing the holding mouth, a stop section being disposed on at least one of the holding sections of the elastic members for blocking the split, the holding mouth having a top section positioned in a position at least not lower than a shielding height of the stop section.

2. The wire connection terminal holding structure as claimed in claim 1, wherein the height difference between the electrical connection member and the top section of the holding mouth is at least not smaller than the height difference between the electrical connection member and the stop section.

3. The wire connection terminal holding structure as claimed in claim 1, wherein an end mouth is disposed on the top section of the holding mouth and directed to the perforation in a stretching form, the end mouth being positioned in a position at least not lower than the shielding height of the stop section.

4. The wire connection terminal holding structure as claimed in claim 2, wherein an end mouth is disposed on the top section of the holding mouth and directed to the perforation in a stretching form, the end mouth being positioned in a position at least not lower than the shielding height of the stop section.

5. The wire connection terminal holding structure as claimed in claim 1, wherein a connection member is disposed on one of the elastic members, the connection member extending between the elastic members, the connection member having an elastic arm, the elastic arm extending to the perforation and being bridged between the holding sections, the pushbutton being disposed on the elastic arm and separated from the outer case, the pushbutton being elastically movably positioned in the perforation, the elastic arm being formed with a curved section, the curved section extending between the stop section and the connection member to block a part of the split.

6. The wire connection terminal holding structure as claimed in claim 2, wherein a connection member is disposed on one of the elastic members, the connection member extending between the elastic members, the connection member having an elastic arm, the elastic arm extending to the perforation and being bridged between the holding sections, the pushbutton being disposed on the elastic arm and separated from the outer case, the pushbutton being elastically movably positioned in the perforation, the elastic arm being formed with a curved section, the curved section extending between the stop section and the connection member to block a part of the split.

7. The wire connection terminal holding structure as claimed in claim 3, wherein a connection member is disposed on one of the elastic members, the connection member extending between the elastic members, the connection member having an elastic arm, the elastic arm extending to the perforation and being bridged between the holding sections, the pushbutton being disposed on the elastic arm and separated from the outer case, the pushbutton being elastically movably positioned in the perforation, the elastic arm being formed with a curved section, the curved section extending between the stop section and the connection member to block a part of the split.

8. The wire connection terminal holding structure as claimed in claim 4, wherein a connection member is disposed on one of the elastic members, the connection member extending between the elastic members, the connection member having an elastic arm, the elastic arm extending to the perforation and being bridged between the holding sections, the pushbutton being disposed on the elastic arm and separated from the outer case, the pushbutton being elastically movably positioned in the perforation, the elastic arm being formed with a curved section, the curved section extending between the stop section and the connection member to block a part of the split.

9. The wire connection terminal holding structure as claimed in claim 3, wherein the end mouth is formed with guide slopes directed to the perforation, the pushbutton being formed with oblique push faces directed to the guide slopes.

10. The wire connection terminal holding structure as claimed in claim 4, wherein the end mouth is formed with guide slopes directed to the perforation, the pushbutton being formed with oblique push faces directed to the guide slopes.

11. The wire connection terminal holding structure as claimed in claim 7, wherein the end mouth is formed with guide slopes directed to the perforation, the pushbutton being formed with oblique push faces directed to the guide slopes.

12. The wire connection terminal holding structure as claimed in claim 9, wherein a notch is formed between the end mouth and the guide slopes, the respective oblique push faces being interconnected to form a ridge section extending to the end mouth to block the notch, the ridge section having a stop face directed to one side of the notch.

13. The wire connection terminal holding structure as claimed in claim 10, wherein a notch is formed between the end mouth and the guide slopes, the respective oblique push faces being interconnected to form a ridge section extending to the end mouth to block the notch, the ridge section having a stop face directed to one side of the notch.

14. The wire connection terminal holding structure as claimed in claim 5, wherein one of the elastic members and the connection member are assembled and connected with each other by means of a latch member and a latch recess.

15. The wire connection terminal holding structure as claimed in claim 6, wherein one of the elastic members and the connection member are assembled and connected with each other by means of a latch member and a latch recess.

16. The wire connection terminal holding structure as claimed in claim 7, wherein one of the elastic members and the connection member are assembled and connected with each other by means of a latch member and a latch recess.

17. The wire connection terminal holding structure as claimed in claim 14, wherein the latch member is formed with a recessed section, while the latch recess is formed with a protrusion section for latching in the recessed section.

18. The wire connection terminal holding structure as claimed in claim 1, wherein the holding sections of the elastic members extend to define the holding mouth, the holding sections further having inward folded sections, which are at least twice inward folded to achieve a complete holding gap.

19. The wire connection terminal holding structure as claimed in claim 2, wherein the holding sections of the elastic members extend to define the holding mouth, the holding sections further having inward folded sections, which are at least twice inward folded to achieve a complete holding gap.

20. The wire connection terminal holding structure as claimed in claim 3, wherein the holding sections of the elastic members extend to define the holding mouth, the holding sections further having inward folded sections, which are at least twice inward folded to achieve a complete holding gap.

21. The wire connection terminal holding structure as claimed in claim 4, wherein the holding sections of the elastic members extend to define the holding mouth, the holding sections further having inward folded sections, which are at least twice inward folded to achieve a complete holding gap.

22. The wire connection terminal holding structure as claimed in claim 5, wherein the holding sections of the elastic members extend to define the holding mouth, the holding sections further having inward folded sections, which are at least twice inward folded to achieve a complete holding gap.

23. The wire connection terminal holding structure as claimed in claim 6, wherein the holding sections of the elastic members extend to define the holding mouth, the holding sections further having inward folded sections, which are at least twice inward folded to achieve a complete holding gap.

24. The wire connection terminal holding structure as claimed in claim 9, wherein the holding sections of the elastic members extend to define the holding mouth, the holding sections further having inward folded sections, which are at least twice inward folded to achieve a complete holding gap.

25. The wire connection terminal holding structure as claimed in claim 12, wherein the holding sections of the elastic members extend to define the holding mouth, the holding sections further having inward folded sections, which are at least twice inward folded to achieve a complete holding gap.

26. The wire connection terminal holding structure as claimed in claim 1, wherein the elastic members are a first elastic member and a second elastic member respectively extending from two sides of the electrical connection member.

27. The wire connection terminal holding structure as claimed in claim 2, wherein the elastic members are a first elastic member and a second elastic member respectively extending from two sides of the electrical connection member.

28. The wire connection terminal holding structure as claimed in claim 3, wherein the elastic members are a first elastic member and a second elastic member respectively extending from two sides of the electrical connection member.

29. The wire connection terminal holding structure as claimed in claim 4, wherein the elastic members are a first elastic member and a second elastic member respectively extending from two sides of the electrical connection member.

30. The wire connection terminal holding structure as claimed in claim 5, wherein the elastic members are a first elastic member and a second elastic member respectively extending from two sides of the electrical connection member.

31. The wire connection terminal holding structure as claimed in claim 6, wherein the elastic members are a first elastic member and a second elastic member respectively extending from two sides of the electrical connection member.

32. The wire connection terminal holding structure as claimed in claim 9, wherein the elastic members are a first elastic member and a second elastic member respectively extending from two sides of the electrical connection member.

33. The wire connection terminal holding structure as claimed in claim 12, wherein the elastic members are a first elastic member and a second elastic member respectively extending from two sides of the electrical connection member.

34. The wire connection terminal holding structure as claimed in claim 14, wherein the elastic members are a first elastic member and a second elastic member respectively extending from two sides of the electrical connection member.

35. The wire connection terminal holding structure as claimed in claim 18, wherein the elastic members are a first elastic member and a second elastic member respectively extending from two sides of the electrical connection member.

36. The wire connection terminal holding structure as claimed in claim 19, wherein the elastic members are a first elastic member and a second elastic member respectively extending from two sides of the electrical connection member.

* * * * *